United States Patent [19]

Long et al.

[11] 4,408,959

[45] Oct. 11, 1983

[54] CERAMIC RADIAL TURBINE WHEEL

[75] Inventors: William D. Long, Tonawanda, N.Y.; Paul J. Rottenkolber, Wolfsburg, Fed. Rep. of Germany

[73] Assignees: Kennecott Corporation, Stamford, Conn.; Volkswagenwerk Aktiengesellschaft, Wolfsburg, Fed. Rep. of Germany

[21] Appl. No.: 224,509

[22] PCT Filed: Apr. 17, 1980

[86] PCT No.: PCT/US80/00419

§ 371 Date: Jul. 3, 1980

§ 102(e) Date: Jul. 3, 1980

[87] PCT Pub. No.: WO81/03047

PCT Pub. Date: Oct. 29, 1981

[51] Int. Cl.[3] ..... F01D 5/34

[52] U.S. Cl. ..... 416/241 B; 415/214

[58] Field of Search ..... 416/241 B, 229; 415/214

[56] References Cited

U.S. PATENT DOCUMENTS

| | | | |
|---|---|---|---|
| 2,297,508 | 9/1942 | Schütte | 416/241 B X |
| 3,664,766 | 5/1972 | Rahnke | 416/241 B X |
| 3,666,302 | 5/1972 | Kellett | 416/241 B X |
| 3,801,226 | 4/1974 | Bevan et al. | 416/241 B |
| 3,897,171 | 7/1975 | Stahl | 416/241 B X |
| 4,063,850 | 12/1977 | Hueber et al. | 416/241 B X |
| 4,175,911 | 11/1979 | Tiefenbacher | 416/241 B X |
| 4,295,791 | 10/1981 | Johnson | 416/241 B |

FOREIGN PATENT DOCUMENTS

| | | | |
|---|---|---|---|
| 2728823 | 1/1979 | Fed. Rep. of Germany | 416/241 B |
| 2734747 | 2/1979 | Fed. Rep. of Germany | 416/241 B |
| 2845715 | 4/1980 | Fed. Rep. of Germany | 416/241 B |
| 1517400 | 7/1978 | United Kingdom | 416/241 B |

*Primary Examiner*—Everette A. Powell, Jr.

*Attorney, Agent, or Firm*—Raymond W. Green; R. Lawrence Sahr

[57] ABSTRACT

A ceramic turbine wheel (1), especially such a wheel intended for an exhaust gas driven turbine of a turbocharger for motor vehicles, comprises a body portion (3), blades (2) and hub portion (4). The body portion (4), and optionally the hub portion (3) as well, are provided with hollow central cores (5, 6).

16 Claims, 4 Drawing Figures

CERAMIC RADIAL TURBINE WHEEL

TECHNICAL FIELD

The invention relates to a ceramic turbine wheel, expecially a ceramic radial turbine wheel for an exhaust gas driven turbine of a turbocharger for motor vehicles, with a body which is formed in one piece with radial blades and a hub which is connectable to a usually metallic turbine shaft.

BACKGROUND ART

With turbochargers for combustion engines in a power range suitable for motor vehicles, the turbine driving the compressor is fed by the exhaust gas of the combustion engine and to date has usually been constructed out of metallic alloys having high strength at high temperatures.

With reference to the increasing use of turbochargers in automobiles, an increased high temperature strength and an improved behavior of acceleration is desired. These requirements could be fulfilled by the use of ceramic materials in the turbocharger turbine. Ceramic materials, such as silicon nitride or silicon carbide, have a nearly constant high strength in the range of temperature under consideration, and have a density which is only one-third of that of a metallic material.

Due to the high temperature strength of such materials, the operating temperatures can be raised without danger, while the mass moment of inertia, due to the relative low density of the ceramic turbocharger rotor, can be reduced to about 40% of the moment of inertia of a metallic type rotor, and therefore, the time of response of the turbocharger correspondingly improves.

The experiments to develop such turbine wheels out of ceramic materials have up to now not yet led to the desired success, as there have resulted difficulties in the production process of the wheel, as well as other problems. Inadmissable defects to the components were found in the preferred, low-cost process, in which the radial turbine wheels, produced out of the ceramic material, are first of all fabricated as so-called green parts by injection molding or slip-casting techniques and afterwards subjected to a burn-out procedure for the binder followed by sintering or nitriding procedures. These defects are mainly attributed to a prevented escape of the gases produced by the burn-out of the binder as well as by a non-uniform shrinkage of the wheel with the solid body of the hub. A central, hollow bore, which would be favorable for the production process, is however not realizable for strength reasons, as by that shape the tensions resulting in operation would be increased to double the value of a hub without a bore.

The object of this invention is therefore construction of a ceramic turbine wheel, which, although it has a sufficient high temperature strength, does not show the above described difficulties in production.

DISCLOSURE OF INVENTION

This invention, accordingly, provides a ceramic turbine wheel, comprising:

(a) a body portion, symmetrical about an axis;

(b) a plurality of blades, integral with and extending outwardly from the body portion; and (c) a hub portion, integral and coaxial with the body portion, symmetrical about the axis, and connectable with a turbine shaft;

characterized in that the body portion is provided with a hollow central core, on the side of the body portion opposite the hub portion.

By providing the body portion with a hollow central core, gases can emerge from the burn-out of the binder and escape out of the body, so that the formation of flaws is largely prevented.

In addition, according to this invention, the portion of the turbine from which the blades extend outwardly, will become more elastic, so that deformations of the blades can be taken up sooner without damage.

A radial turbine wheel, designed according to this invention, is producible without large difficulties by inexpensive production processes like injection molding or slip casting out of ceramic materials, e.g. silicon nitride and silicon carbide, wherein particularly the before mentioned difficulties in the necessary procedures of burn-out of the binders as well as in sintering and nitriding are prevented.

Especially with the material alpha silicon carbide, which shows in the mentioned production processes under high temperatures a large shrinkage, this design enables production with substantially reduced difficulties. See U.S. Pat. Nos. 4,124,667 and 4,144,207, regarding sintering and injection molding of alpha silicon carbide.

In addition, the design of the hub, according to the invention, results in a further reduction of the mass moment of inertia, already lowered by the use of ceramic material.

BEST MODE FOR CARRYING OUT THE INVENTION

Figure 2:
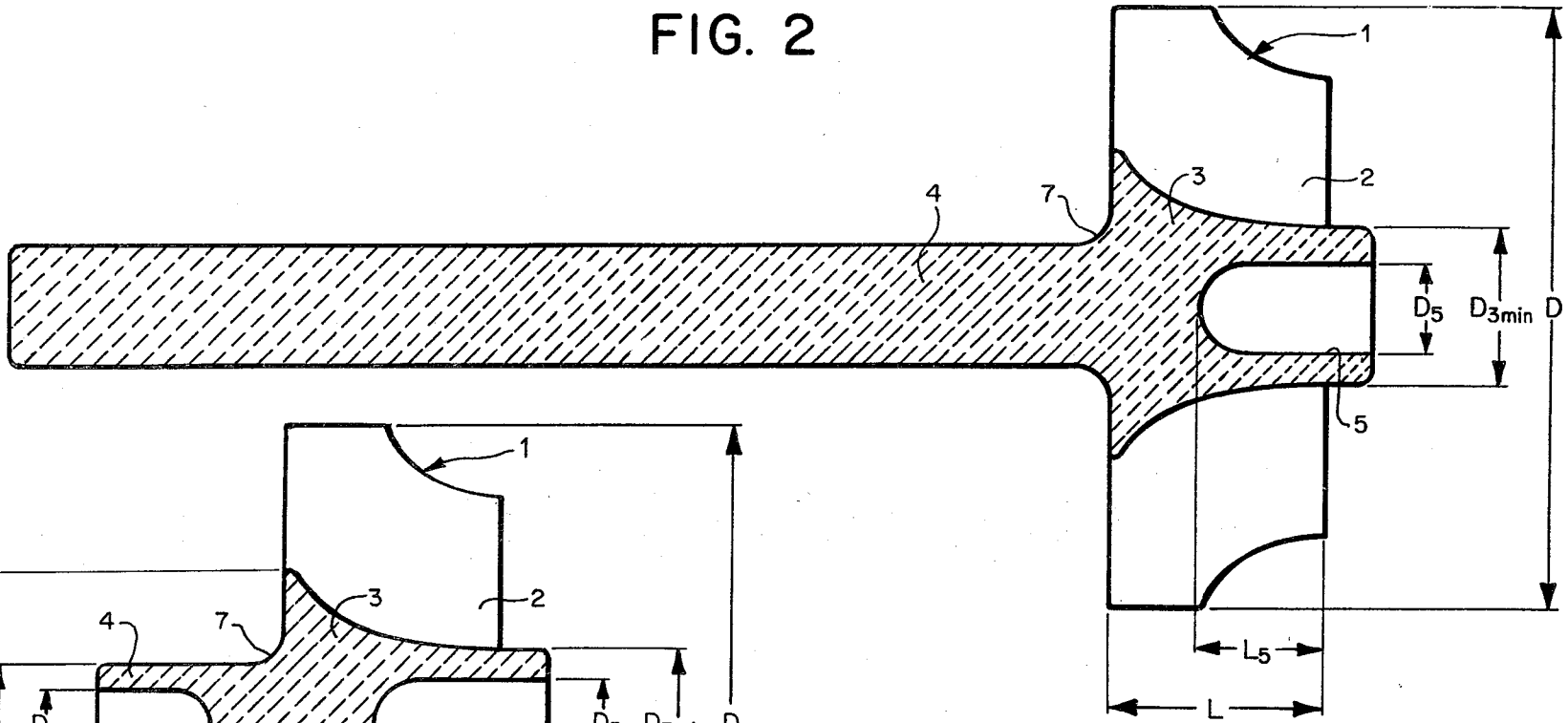
FIG. 2 is an alternate embodiment of the invention having a solid integral shaft.

In the drawing there is designated by 1, the radial turbine wheel as a whole; by 2, the blades which extend outwardly, usually radially, from the body portion; and by 3 the body portion, which is formed in one piece with blades 2 and the hub portion 4. The hub portion 4 is provided for connection with a usually metallic, sometimes ceramic turbine shaft, which is not shown here.

The blades 2 are described as "radial", i.e. not "axial". In the turbocharger art, the two main types of blade arrangements are "radial" and "axial". In the "radial" type, portions of the blades 2, near the hub portion 4, are located along radii of the body portion 3; and portions of the blades 2, further from the hub portion 4, are curved gently in the same direction.

According to the invention, the body portion 3 has on the side opposite to the hub portion 4 a hollow central core 5, whose outer diameter, designated with $D_5$, should preferably not exceed 60% of the smallest outer diameter, designated with $D_{3min}$, of the body portion 3; and whose length, designated with $L_5$, should preferably not exceed 60% of the axial blade length, designed by L. It should be noted that $L_5$ extends only from the base of the hollow central core 5 to the extremity of the blades 2, and not to the extremity of the hollow central core 5. In other words, at least 40% of the blade length L should extend from a non-hollow part of body portion 3. With such proportions, no noticible increases in tension appear in the body portion 3. In the case of less stressed turbine wheels, the hollow central core 5, rounded at its bottom, could be placed even deeper, in consideration of expediency.

It is preferred that the minimum outer diameter, $D_{3min}$, of the body portion 3, be at the side of the body portion 3 opposite to the hub portion 4, and that the maximum outer diameter, $D_{3max}$, of the body portion 3, be at the side of the body portion 3 adjacent to the hub portion 4, of the turbine wheel 1.

For the relative proportions of the outer diameters $D_{3min}$ and $D_{3max}$ it is preferred that these should amount to about 25% and 50% respectively, of the outer diameter of the wheel, D. In following these rules, in view of strength and production requirements, an optimized turbine wheel can be obtained.

The hub portion 4 preferably has a diameter $D_4$ of about 15 to 25%, more preferably 15 to 20%, of the outer diameter D of the wheel.

Figure 1:
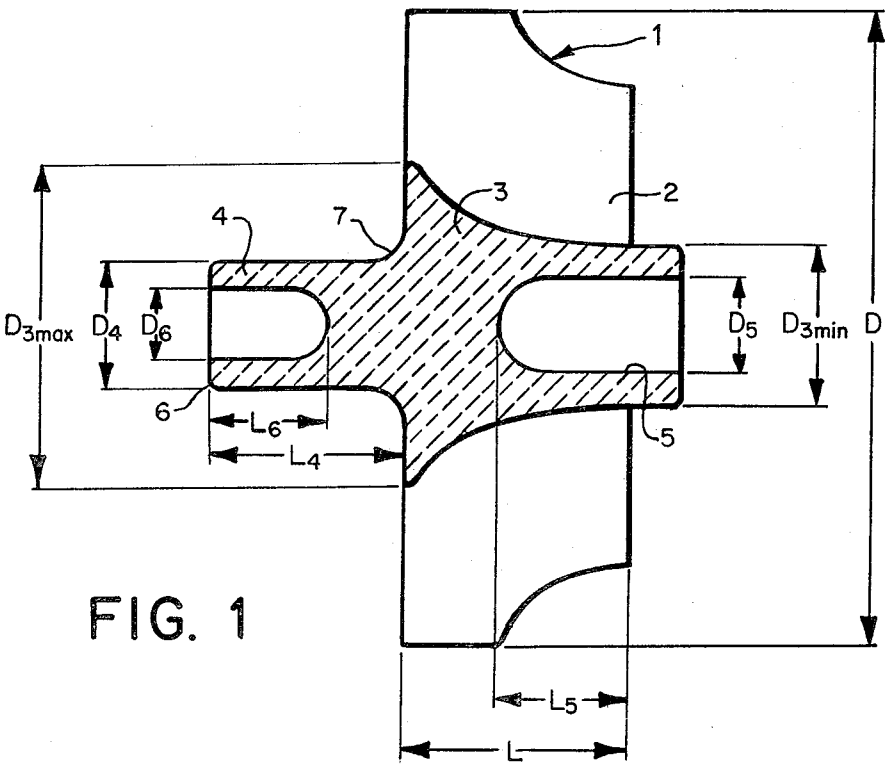
In FIG. 1 of the drawing an example of design of the invention is shown, which will be explained in the following. The drawing shows schematically a presentation of a cross section, according to the invention, of a preferred embodiment of a ceramic radial turbine wheel for the turbocharger of a combustion engine for a motor vehicle, in which the hub portion is cylindrical.

According to one preference shown in FIG. 1, the hub portion 4 has a length $L_4$ of, at most, twice its diameter $D_4$. According to another preference, the hub portion 4 is integral with the shaft, see FIGS. 2 and 3. The shaft can be either a solid (FIG. 2) or hollow (FIG. 3) cylinder, made as an extension of hub portion 4, from about 6 up to about 12 times the diameter $D_4$ of the hub portion 4.

Figure 3:
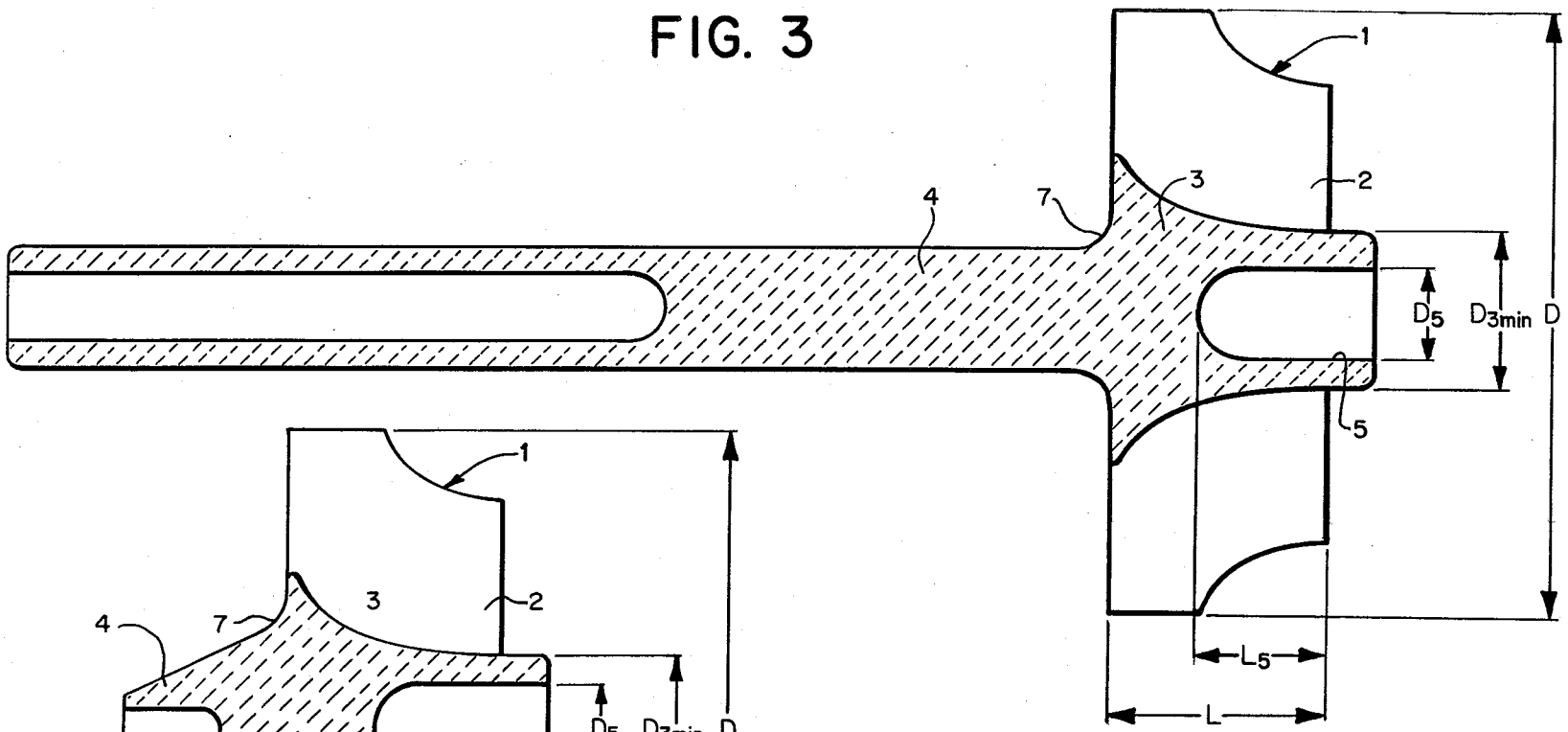
FIG. 3 is a further alternate embodiment having an integral hollow shaft.

On the hub portion 4, as shown in FIGS. 1 and 3, there can optionally also be provided a hollow central core 6, rounded at its bottom, whose diameter $D_6$ amounts to at most up to about 60% of the diameter of the hub portion 4 and whose length $L_6$ is at most 60% of the length $L_4$ of the hub portion 4.

Finally, at the transition 7 from the hub portion 4 to the body portion 3, there should preferably be provided a radius of at least 20% of the diameter of the hub portion 4.

By adherence to these rules of dimension for the production out of ceramic materials an optimally designed radial turbine wheel results, which offers favorable properties regarding to its strength as well as regarding to its production process.

Figure 4:
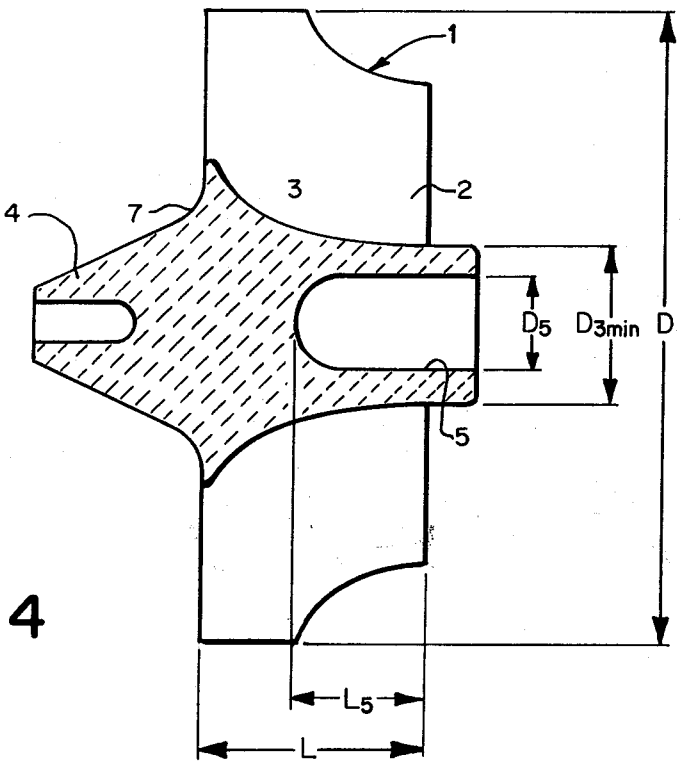
FIG. 4 is an alternate embodiment illustrating a conical design for the hub portion of the ceramic radial turbine of the invention.

The embodiment shown in FIG. 1 of the drawing has a cylindrical hub portion 4. In the case of an alternate conical design of the hub portion 4, shown in FIG. 4, the basic diameter measured at about 60% of its length, measured from its end, corresponds to the diameter $D_4$ of the cylindrical design. The cone angle of this design can amount to between 20° and 30° inclusive, preferably about 25°.

Also, this conical hub portion, in consideration of expediency, can possess a hollow central core, whose diameter is at most 60% of the minimum diameter of the conical hub portion and whose axial length is at most 60% of the length of the hub portion. In addition, it is advantageous that the hollow central core, according to this embodiment of the invention, is rounded at its bottom.

Finally, it is suggested that, as with the cylindrical embodiment, the transition from the conical hub portion to the body is rounded with a radius of at least 20% of the diameter of the hub portion.

We claim:

1. A radial ceramic turbine wheel, comprising:

(a) a body portion, symmetrical about an axis;

(b) a plurality of blades, integral with and extending outwardly from the body portion; and (c) a hub portion, integral and coaxial with the body portion, symmetrical about the axis, and connectable with a turbine shaft; characterized in that the body portion is provided with a hollow central core, on the side of the body portion opposite the hub portion; in that the blades extend outwardly partly from the hollow central core of the body portion, and partly from the solid part of the body portion; and in that the axial length of that part of the hollow central core of the body portion from which the blades extend does not exceed 60% of the axial length of the blades.

2. A ceramic turbine wheel according to claim 1, characterized in that the outer diameter of the hollow central core of the body portion does not exceed 60% of the smallest diameter of the body portion.

3. A ceramic turbine wheel according to claim 1, characterized in that the body portion has, at the side adjacent to the hub portion, an outer diameter of about 50% of the outer diameter of the turbine wheel.

4. A ceramic turbine wheel according to claim 1, characterized in that the body portion has, at the side opposite to the hub portion, an outer diameter of about 25% of the outer diameter of the turbine wheel.

5. A ceramic turbine wheel according to claim 1, characterized in that the hub portion is cylindrical.

6. A ceramic turbine wheel according to claim 5, characterized in that the hub portion has a diameter of from about 15 to about 20% of the outer diameter of the turbine wheel.

7. A ceramic turbine wheel according to claim 5, characterized in that the hub portion has an axial length which does not exceed twice the diameter of the hub portion.

8. A ceramic turbine wheel according to claim 5, wherein the hub portion is formed integrally with a ceramic shaft, the shaft being cylindrical, and of a length of from about 6 to about 12 times the diameter of the hub portion.

9. A ceramic turbine wheel according to claim 8, wherein the shaft is a hollow cylinder.

10. A ceramic turbine wheel according to claim 8, wherein the shaft is a solid cylinder.

11. A ceramic turbine wheel according to claim 5, characterized in that the hub portion has a hollow central core.

12. A ceramic turbine wheel according to claim 11, characterized in that the hollow central core of the hub portion has a diameter not exceeding 60% of the diameter of the hub portion.

13. A ceramic turbine wheel according to claim 11, characterized in that the hollow central core of the hub portion has an axial length not exceeding 60% of the length of the hub portion.

14. A ceramic turbine wheel according to claim 11, characterized in that the hollow central core of the hub portion has a rounded bottom.

15. A ceramic turbine wheel according to claim 5, characterized in that the transition from the hub portion to the body portion is rounded off with a radius of at least 20% of the diameter of the hub portion.

16. A ceramic turbine wheel according to claim 1, characterized in that the hub portion is conical.

* * * * *